United States Patent [19]

Rommel

[11] 4,342,206

[45] Aug. 3, 1982

[54] DEVICE FOR APPLYING DYE PATTERNS ONTO CONTINUOUSLY MOVING WEBS OF MATERIAL

[75] Inventor: Heinz Rommel, Seevetal, Fed. Rep. of Germany

[73] Assignee: Firma Babcock Textilmaschinen KG (GmbH & Co.), Seevetal, Fed. Rep. of Germany

[21] Appl. No.: 144,494

[22] Filed: Apr. 28, 1980

[30] Foreign Application Priority Data

Apr. 27, 1979 [DE] Fed. Rep. of Germany ..... 2917146

[51] Int. Cl.[3] ..... D06B 1/04; D06B 11/00

[52] U.S. Cl. ..... 68/205 R

[58] Field of Search ..... 68/205 R, 200; 118/315, 118/324, 325; 239/214, 218, 222.11, 222.21, 382

[56] References Cited

U.S. PATENT DOCUMENTS

| | | | |
|---|---|---|---|
| 3,937,044 | 2/1976 | Balmforth | 68/205 R |
| 4,127,014 | 11/1978 | Miller et al. | 68/205 R X |
| 4,170,958 | 10/1979 | Moser | 68/205 RX |
| 4,198,836 | 4/1980 | Goodson | 68/205 R |

FOREIGN PATENT DOCUMENTS

| | | | |
|---|---|---|---|
| 597433 | 3/1978 | U.S.S.R. | 118/325 |

*Primary Examiner*—Philip R. Coe

*Attorney, Agent, or Firm*—Allison C. Collard; Thomas M. Galgano

[57] ABSTRACT

A device for applying dye in the form of geometric patterns or randomly-distributed drops onto continuously moving webs of material or the like, includes oscillating breaking bars which are mounted above the web of material perpendicular and/or in the direction of the moving web of material or in the counter direction thereof, and/or transversely thereto. The dyes are supplied in individual streams to these breaking bars.

12 Claims, 5 Drawing Figures

DEVICE FOR APPLYING DYE PATTERNS ONTO CONTINUOUSLY MOVING WEBS OF MATERIAL

The present invention relates to a device for applying dyes in the form of geometric patterns or irregular or random drops onto continuously moving webs of material or the like.

It is known in the art how to apply dyes in the form of lines or stripes onto continuously moving webs of material. This is done by means of dye containers with discharge openings or overflow outlets which are disposed above the web of material, whereby the dye is applied in liquid streams onto the web of material. Different patterns may be obtained by moving the dye containers transversely relative to the moving direction of the web of material. With these types of devices, no substantial variations in patterns may be obtained.

For example, in order to obtain a dot-like dye application which, in accordance with the latest desired requirements, should be irregular or randomly distributed, it was previously suggested to separate the previously generated dye streams into individual drops by moving grates or the like and to distribute these individual drops irregularly or randomly onto the web of material. These devices generally operate satisfactorily, but are not adjustable for different design requirements.

It is therefore an object of the present invention to provide for a patterned application of dyes onto continuously moving webs of material with which not only stripe-like patterns can be produced in a great many varieties, but also dot-like patterns having any desired dot distribution.

This object of the invention is obtained in accordance with the invention by the provision of a device having oscillating breaking or separator bars or rails mounted above the web of material, disposed in a direction perpendicular to the web of material and/or in the direction of the moving web of material or in a counter direction thereto, and/or transversely thereto, whereby the dyes are supplied in individual streams to the breaking bars or separator rails. The separator rails are preferably mounted on support elements which are coupled with drive means which, for example, may be oscillating plates of known construction for generating oscillations in a direction perpendicular to the feeding movement of the web of material, in the feeding direction of the web of material, or in a counter direction thereto. It has been shown to be particularly advantageous for the support elements to be in the form of support pipes which are coupled to a normal electric motor by means of a double eccentric for adjusting the oscillating frequency and amplitude.

The breaking bars or separator rails are provided with guide elements for the individual dye streams which may be mounted on the support pipes in the flow direction of the liquid streams in front of the separator rails, for example. However, on one support pipe a plurality of separator rails having guide elements of different shapes may be provided which can be selectively brought into operating position to create different patterns. The guide elements may also be mounted at the front end of the separator rails. In particular, the latter embodiment permits mounting of two separator rails with associated guide elements for different dye applications which reduces the construction of the apparatus substantially.

It has been shown to be advantageous to facilitate the division of or breaking up of the dye streams by the provision of tips, teeth or the like mounted on the front edges of the separator rails. In a further embodiment for forming randomly-distributed drops, air jets are mounted below the separator rails which are directed towards the edges of the separator rails. For generating dye streams from a dye bath, the separator rails are preferably provided with individual stream-forming supply channels, distribution guides, or the like.

Other objects and features of the present invention will become apparent from the following detailed description when taken in connection with the accompanying drawings which schematically illustrate several embodiments of the invention. It is to be understood that the drawings are designed for the purpose of illustration only and are not intended as a definition of the limits of the invention.

Figure 3A:
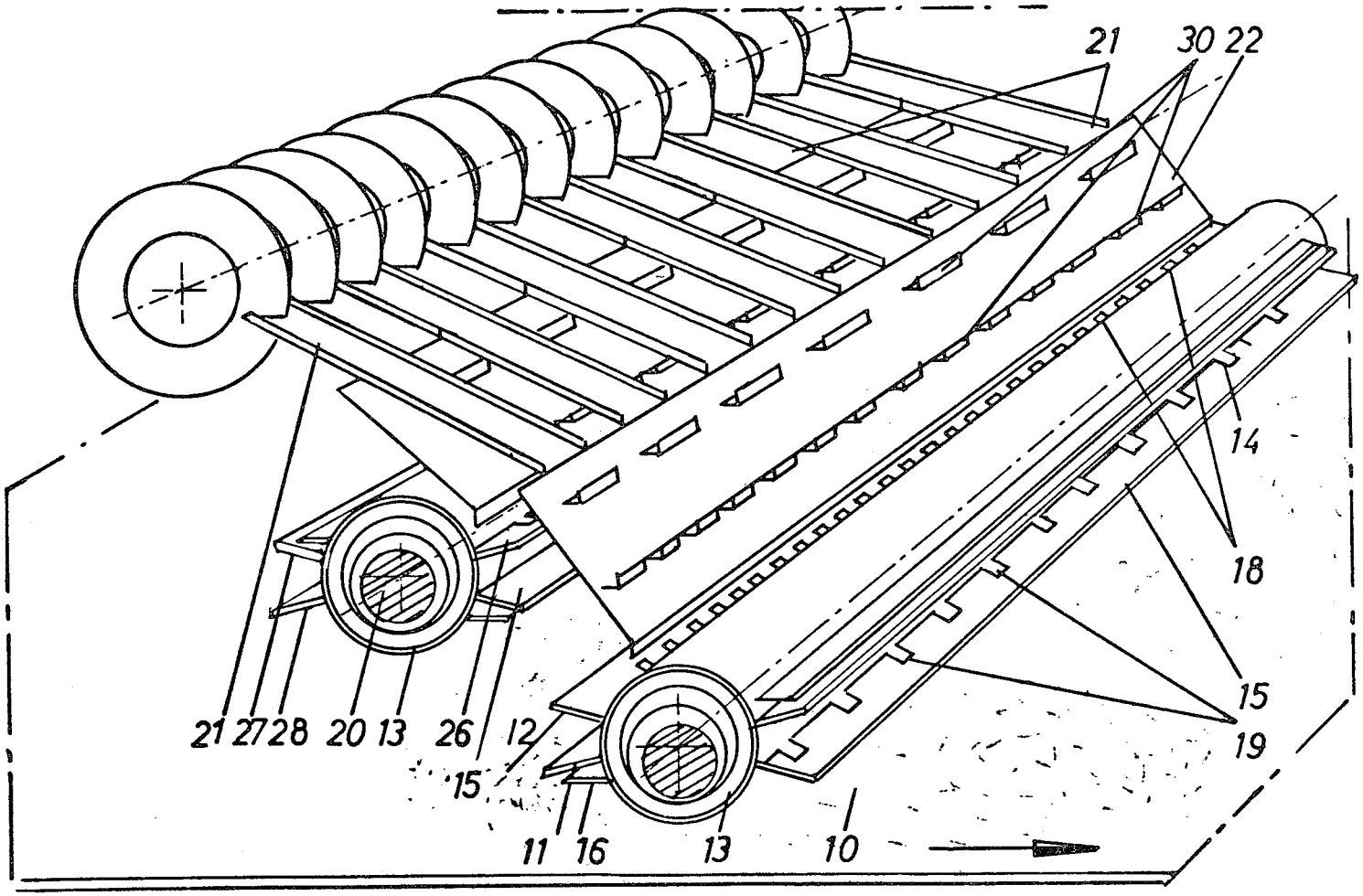
Figure 3B:
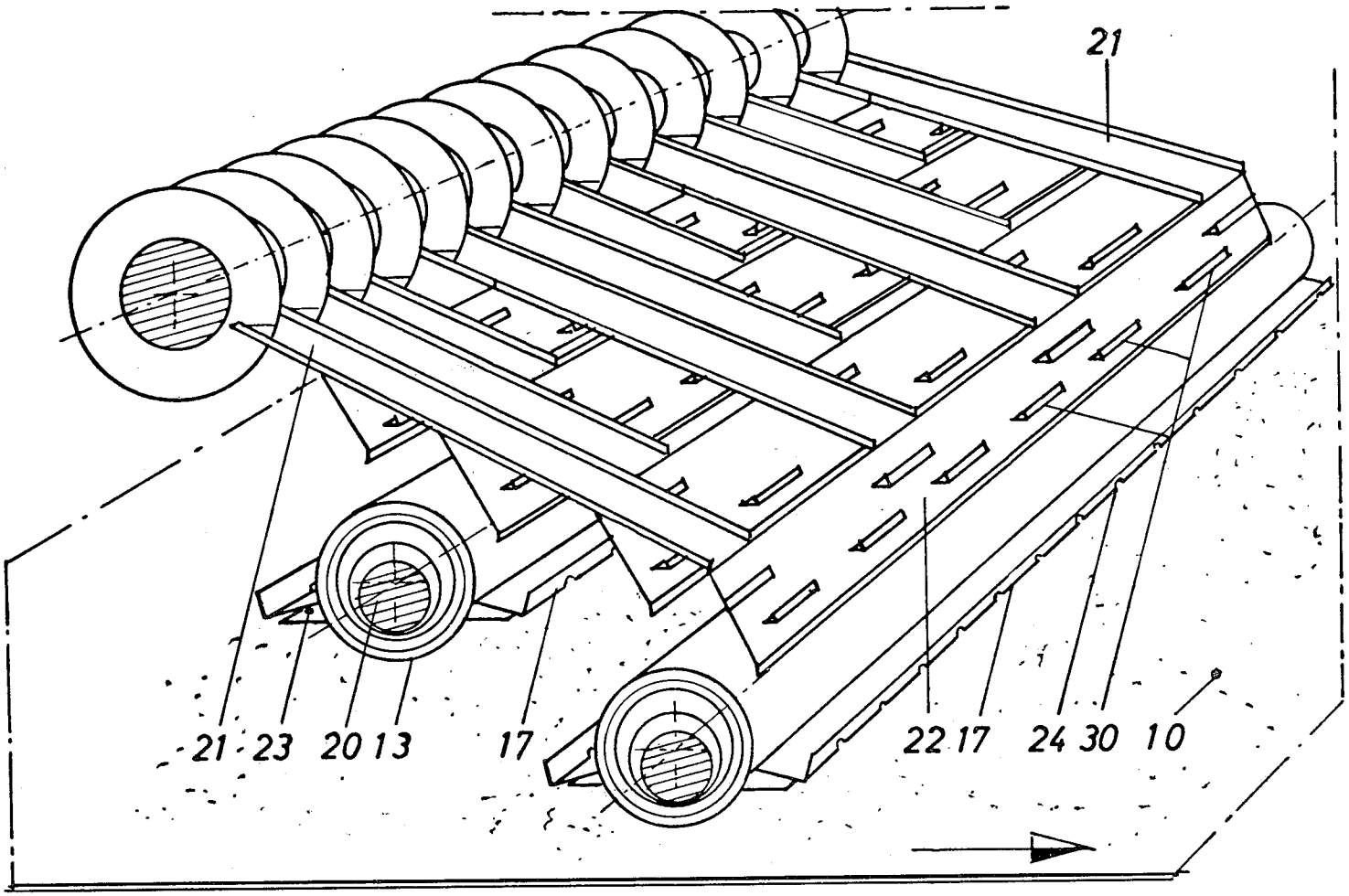
Figure 4:
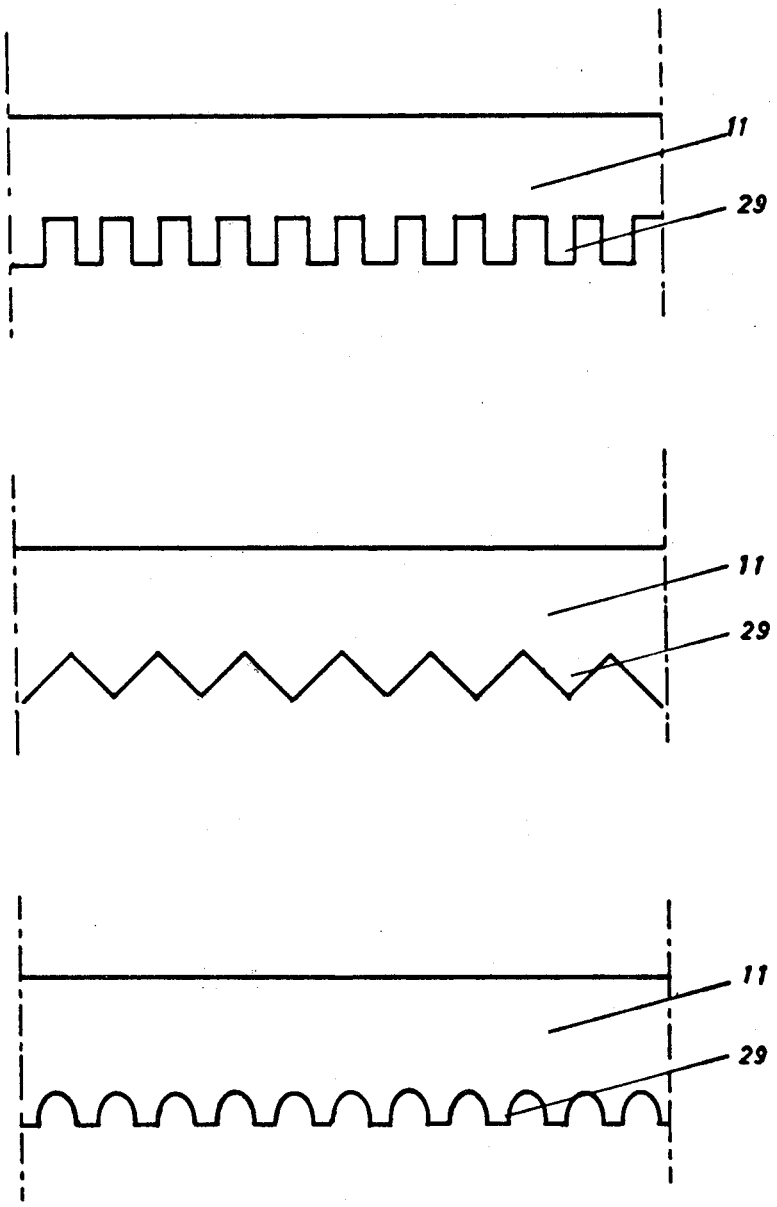

FIGS. 3*a* and 3*b* are perspective views showing different layouts of the inventive device in a pattern-producing apparatus; and FIG. 4 is a plan view of three different special shapes for the breaking bars.

Figure 1:
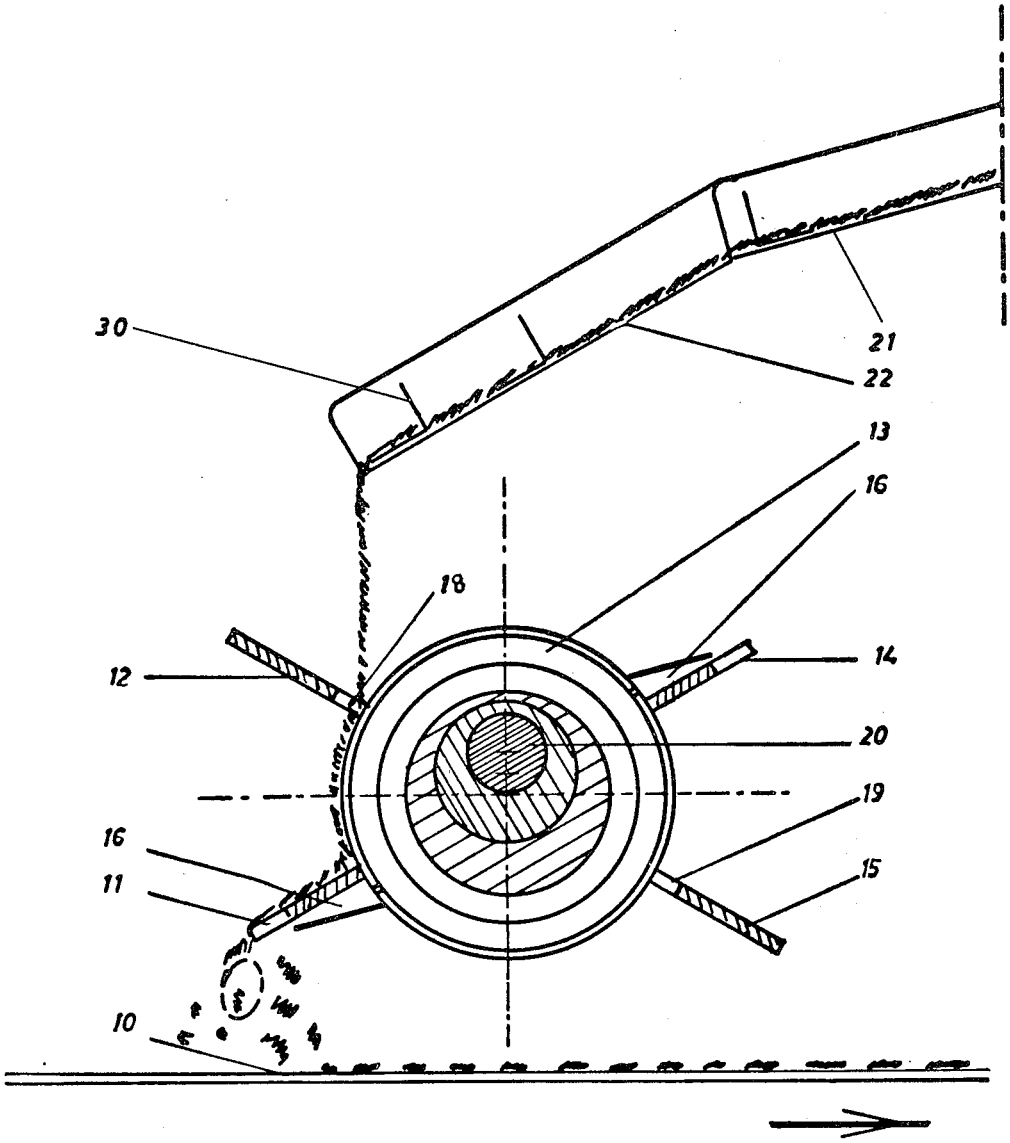
FIG. 1 is a schematic side sectional view, in part elevation of a device embodying the present invention, having a support pipe with breaking bars for generating stripe or dot-like patterns.

Referring now in detail to the drawings, FIG. 1 illustrates one embodiment of a support pipe 13 having different separator or breaking bars or rails 11, 14 and associated guide elements 12, 15. As can be seen, the support pipe is provided with a double eccentric drive 20, so that the frequency, as well as the amplitude, of the oscillations of the support pipe are variable. In this embodiment, guide elements 12, 15 which are mounted on support pipe 13 are provided with differently-configured apertures 18, 19. As a result, by a turning of support pipe 13, different patterns may be obtained with the same support pipe. For this purpose, the support pipe is turned by about 180°, so that the liquid streams are supplied to guide element 15 which has differently-configured apertures and to the separator bar 14. From there the dye in the form of drops is fed onto the web of material 10. The movement of the separator bars when driving the support pipe is indicated in the left portion of this figure.

Below the breaking bars 11, 14 air jets 16 are mounted for an additional distribution of the dye streams into dye drops. The dye streams discharge from a stream generating device and flow through supply channels 21 to guide elements 22 on which members 30 may be provided for a further distribution of the streams. In the shown embodiment, the dye streams flow from guide element 12 which evens or balances out the streams and flow through apertures 18 along the support pipe and then from there to the front edge of breaking bar 11 which, due to its eccentric drive, carries out an oscillating movement and thereby separates the streams into drops which fall onto the web of material 20 which moves below the breaking bar.

Figure 2:
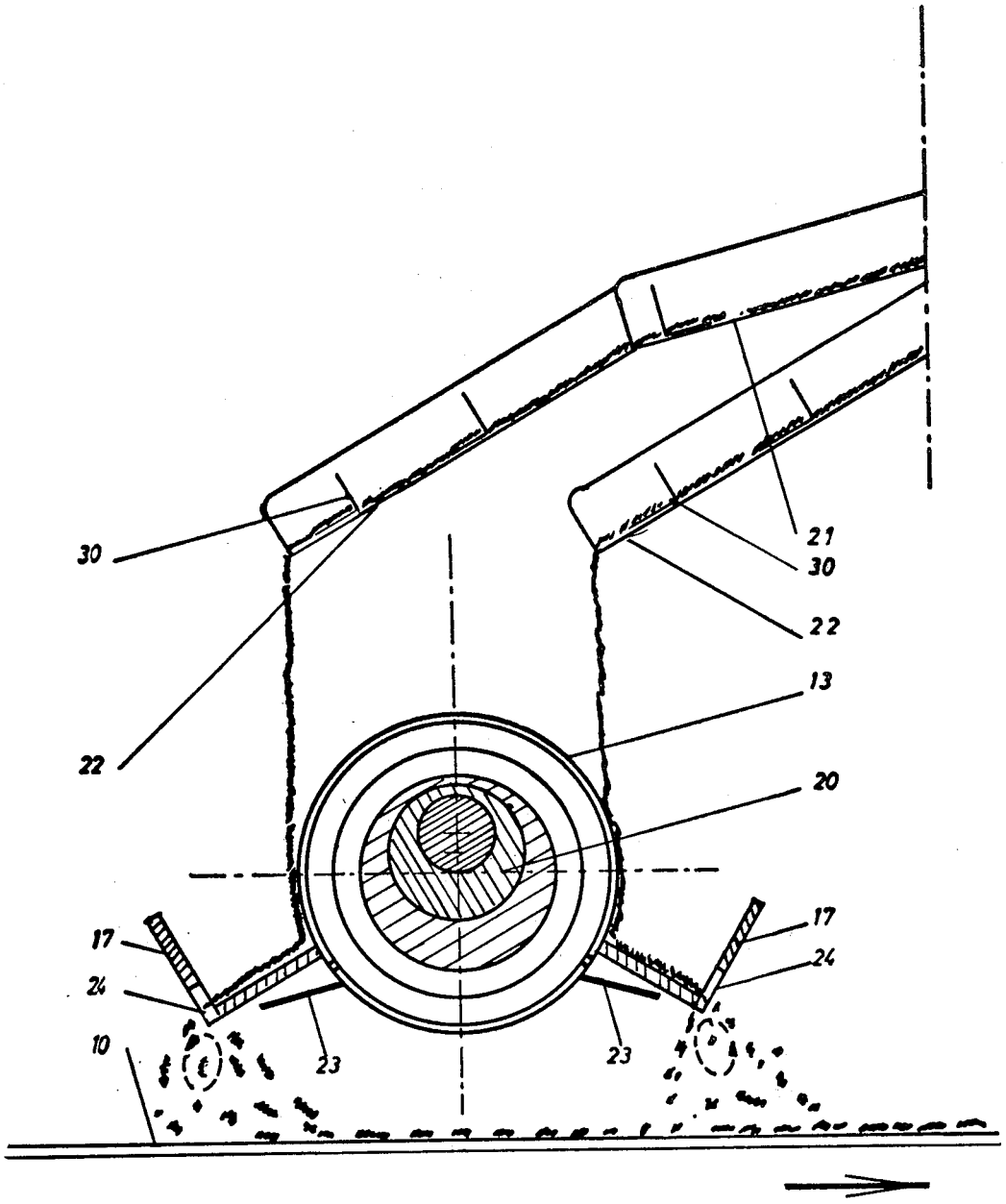
FIG. 2 is a schematic view comparable to that of FIG. 1, but showing another embodiment for the structure of the breaking bars.

The embodiment in accordance with FIG. 2 corresponds substantially to the embodiment shown in FIG. 1 with the exception that support pipe 13 is provided with two breaking bars 17 wherein the guide elements with the associated apertures 24 are mounted on the front part of the breaking bars. Above each breaking bar 17, channels 21 and guide elements 22 together with the stream separators 30 can be seen. In this embodiment, the air supply for the air jets 23 is carried out through the inner chamber of support pipe 13.

FIGS. 3*a* and 3*b* show the inventive device of FIGS. 1 and 2, respectively incorporated within the total structure of an apparatus for applying dye patterns onto webs of carpets, for example. Therein, the different dyes are removed from dye vats or containers by means of a toothed roller and are fed in the form of dye streams to supply conduits or channels 21 where the streams may be separated into a plurality of even or uniform streams. From there the dye streams flow to a distribution element 22 which may be provided with further stream separators 30.

The dye streams flow from the distribution element 22 to the guide elements 12, 26 or 15 and 28, which are mounted on the support pipes 13, depending on how the support pipes are adjusted. The dye streams flow through apertures 18 and 19 along the support pipe onto the breaking bars 11, 25 or 14 and 27. Due to the double eccentric drive of the successively mounted support pipes 13 and breaking bars in the feeding direction of the dye, drops are then dropped in an irregular or random pattern onto the web of material.

With the apparatus shown in FIG. 3*a*, two different dyes may be applied. However, a plurality of dyes may be applied simultaneously as shown in FIG. 3*b*, wherein four different dyes are applied. Alternatively, a plurality of dyes may be applied by the provision of two or a plurality of stations in accordance with FIG. 2, or a plurality of stations as shown in FIG. 3*a* are successively arranged or mounted.

In cooperation with the oscillation of the support pipes 13 in a perpendicular direction with respect to the web of material, as well as in the feeding direction or in a counter direction to the feeding direction, an oscillation directed transversely with respect to the feeding direction of the web of material may be added. This transverse oscillation is generated by an electric motor which is coupled with the support pipe and a stroke adjustable crank drive.

FIG. 4 illustrates three different embodiments of the breaking bar 11, wherein special teeth 29 are mounted at the front edge for improved drop formation.

Thus, while only several embodiments of the present invention have been shown and described, it will be obvious that many changes and modifications may be made thereunto, without departing from the spirit and scope of the invention.

What is claimed is:

1. A device for applying dyes in the form of geometric patterns or random drops onto continuously moving webs of material, comprising:

a support element;

at least one separator bar mounted on said support element;

means for supplying individual dye streams to said separator bar; and drive means coupled to said support element for generating oscillations in said support element and, in turn, said separator bar perpendicular to as well as in the moving direction and counter direction of the travel direction of the web of material.

2. The device according to claim 1, wherein said drive means are oscillating plates.

3. The device according to claim 1, wherein said support element comprises a support pipe which is coupled to an electric motor by means of a double eccentric for adjusting the oscillation frequency and amplitude.

4. A device for applying dyes in the form of geometric patterns or random drops onto continuously moving webs of material, comprising:

a support element which comprises a support pipe;

at least one separator bar mounted on said support pipe;

means for supplying individual dye streams to said separator bar; and drive means coupled to said support pipe for generating oscillations in said support pipe and, in turn, said separator bar perpendicular to as well as in the moving direction and counter direction of the travel direction of the web of material, said drive means comprising an electric motor coupled to said support pipe by means of double eccentric drive means for adjusting the oscillation frequency and amplitude of said support pipe and, in turn, said separator bar.

5. The device according to claim 1 or 4, additionally including at least one guide element mounted on said support element positioned in the flow path of the liquid streams between said means for supplying and said separator bar and disposed for cooperation with said separator bar for guiding the individual dye streams thereto.

6. The device according to claim 5, wherein a plurality of said separator bars and guide elements are provided, wherein said guide elements have different stream-forming structures, and wherein said separator bars and associated guide elements are mounted on said support element, said support element being rotatable to bring said separator bars and guides into alternate selective operating positions.

7. The device according to claim 5, wherein said separator bar has a front end projecting outwardly from said support element and wherein said guide element is mounted on the front end of said separator bar.

8. The device according to claim 5, wherein two separator bars and two associated guide elements are mounted on said support element for applying different dye patterns.

9. The device according to claim 1, wherein said separator bar has a continuous, toothed front edge projecting outwardly from said support element.

10. The device according to claim 1, wherein said separator bar has a front edge projecting outwardly from said support element and wherein an air jet is mounted below said separator bar which is directed towards said front edge of the separator bar for effecting further distribution of the dye streams into dye drops.

11. The device according to claim 1, wherein said menas for supplying comprises individual stream-forming supply channels having distribution guides.

12. The device according to claim 1, wherein said separator bar is disposed in a direction transversely to said web of material.

* * * * *